US009332838B1

(12) United States Patent
Kilday et al.

(10) Patent No.: US 9,332,838 B1
(45) Date of Patent: May 10, 2016

(54) SHELF UNIT

(71) Applicant: GRK Manufacturing Company, Hamilton, OH (US)

(72) Inventors: Gary R. Kilday, Cincinnati, OH (US); Doug A. Liming, Milford, OH (US)

(73) Assignee: GRK Manufacturing Company, Hamilton, OH (US)

( * ) Notice: Subject to any disclaimer, the term of this patent is extended or adjusted under 35 U.S.C. 154(b) by 0 days.

(21) Appl. No.: 14/920,068

(22) Filed: Oct. 22, 2015

(51) Int. Cl.
*A47F 5/00* (2006.01)
*A47F 5/08* (2006.01)
*A47B 47/00* (2006.01)

(52) U.S. Cl.
CPC ..... *A47B 47/0091* (2013.01)

(58) Field of Classification Search
CPC .... A47B 47/042; A47B 47/047; A47B 47/04; A47B 47/0091; A47B 43/00; A47B 45/00; A47F 5/10; A47F 5/13; A47F 5/0018
USPC ..... 108/180, 186, 188; 211/134, 153, 198, 211/189, 186
See application file for complete search history.

(56) References Cited

U.S. PATENT DOCUMENTS 1,599,083 A * 9/1926 Baptiste ..... 211/198
1,917,564 A * 7/1933 Turner et al. ..... 108/101
2,019,090 A * 10/1935 Pepper ..... 211/45
2,119,442 A * 5/1938 Robinson ..... 108/99
2,400,659 A * 5/1946 St-Mars ..... 182/119
3,137,522 A * 6/1964 Smith ..... 108/186
3,170,418 A * 2/1965 Gruenstein ..... 108/101
3,178,198 A * 4/1965 Hamilton ..... 280/79.3
3,948,192 A * 4/1976 Yellin ..... 108/101
4,136,623 A * 1/1979 Dickson ..... 108/186
D259,007 S * 4/1981 Schuckenbrock ..... D6/675.3
4,270,463 A * 6/1981 Korzon ..... 108/96
D273,067 S * 3/1984 Evans ..... D6/674
D294,787 S * 3/1988 Berry, Jr. ..... D6/675.3
D334,309 S * 3/1993 Stricker ..... D6/674
5,853,065 A * 12/1998 Hutson et al. ..... 182/18
6,085,477 A * 7/2000 Hiese et al. ..... 52/270
6,267,345 B1 * 7/2001 Turner ..... 248/447
6,425,646 B1 * 7/2002 Andrews ..... 312/114
6,955,130 B2 * 10/2005 Phillips ..... 108/96
7,789,251 B1 * 9/2010 Clark ..... 211/198
D643,232 S * 8/2011 Wagner ..... D6/675.3
8,210,312 B1 * 7/2012 Tetreault, Jr. ..... 182/119
8,590,716 B2 * 11/2013 Behjat ..... 211/195

(Continued)

FOREIGN PATENT DOCUMENTS

DE 29513833 U1 * 11/1995
FR 2865365 A1 * 7/2005 ..... A47F 3/14

*Primary Examiner* — Joshua Rodden
*Assistant Examiner* — Kimberley S Wright
(74) *Attorney, Agent, or Firm* — Wood, Herron & Evans, LLP

(57) ABSTRACT

A shelf unit has a modular, interlocking design and eliminates the need for hardware components. The shelf unit includes first and second side pieces each including first and second rails and first, second, and third rungs extending between the first and second rails. First and second shelf-supporting connectors attach with the first rungs of the first and second side pieces and the second rungs of the first and second side pieces, respectively, via interlocking slots. A first shelf is positioned atop the first shelf-supporting connector and a second shelf is positioned atop the second shelf-supporting connector.

12 Claims, 7 Drawing Sheets

(56) References Cited

U.S. PATENT DOCUMENTS

| | | | | |
|---|---|---|---|---|
| 8,783,473 | B1 * | 7/2014 | Schosek | 211/85.3 |
| 2001/0054674 | A1 * | 12/2001 | Turner | 248/441.1 |
| 2002/0178979 | A1 * | 12/2002 | Tidemann | 108/186 |
| 2003/0177959 | A1 * | 9/2003 | Phillips | 108/92 |
| 2007/0227989 | A1 * | 10/2007 | Schneider et al. | 211/85.7 |
| 2011/0253651 | A1 * | 10/2011 | Behjat | 211/45 |
| 2012/0060765 | A1 * | 3/2012 | Hough et al. | 119/706 |
| 2015/0164224 | A1 * | 6/2015 | Kemp | |

* cited by examiner

SHELF UNIT

TECHNICAL FIELD

The invention generally relates to shelf units and, more particularly, to shelf units which eliminate the need for hardware components.

BACKGROUND

Conventional shelf units are well known and serve a wide variety of purposes such as, for example, storage and display of goods in residential and commercial applications. Typically, shelf units include a number of horizontally-oriented shelves attached perpendicularly to vertical or diagonal supports and positioned parallel one above the other. The attachment of the shelves to the supports is traditionally accomplished by way of various hardware components, including brackets and/or metal fasteners such as, for example, nails or screws. Additional hardware components such as washers or other spacers may also be required.

The use of hardware components in conventional shelf units, however, requires the shelves and supports to have minimum thicknesses sufficient to receive a nail or screw, for example. If a shelf or support does not meet the minimum thickness requirement, then the nail or screw may not be driven through enough material to sufficiently retain the nail or screw in place. In addition, a shelf or support which does not meet the minimum thickness requirement may fracture or otherwise fail when a nail or screw is driven therethrough. In some instances, the minimum thicknesses of the shelves and supports required to accommodate the hardware components may be more than the minimum thicknesses required to support a target load capacity of the shelf unit. Therefore, the use of hardware components requires the shelves and supports to be constructed of more material than may otherwise be necessary.

In addition, the use of hardware components often complicates and lengthens the shelf unit assembly process. Many conventional shelf units are purchased in a disassembled state, and are assembled by the end-user at the end-user's home, office, or place of business. Therefore, the individual assembling the shelf unit is typically an average person without any assembly or manufacturing expertise. In many instances, the use of a variety of hardware components can cause delay, confusion, and/or frustration, and a mistake in placing hardware may irreversibly damage the shelf unit. Therefore, the use of hardware components requires the end-user to expend significant time and effort when assembling the shelf unit.

There exists a need for a shelf unit that addresses these and other challenges of the prior art.

SUMMARY

It is therefore desirable to provide a shelf unit having a modular, interlocking design so as to eliminate the need for hardware components, the shelf unit including first and second shelves, each oriented horizontally, and further including first and second side pieces. The first and second side pieces each include a top and a bottom, and further include first and second rails and first, second, and third rungs extending between the first and second rails, the third rungs being adjacent the tops, and the first, second, and third rungs each including a first slot. The first side piece is angled acutely relative to the shelves at a first angle and the second side piece is angled acutely relative to the shelves and toward the first side piece at a second angle such that the tops of the first and second side pieces are adjacent to each other. The shelf unit further includes first and second shelf-supporting connectors, the first shelf-supporting connector attaching with the first rungs of the first and second side pieces and the second shelf-supporting connector attaching with the second rungs of the first and second side pieces. The first and second shelf-supporting connectors each include first and second angled slots, wherein the first angled slots are each angled acutely relative to the shelves at the first angle and the second angled slots are each angled acutely relative to the shelves at the second angle. The first angled slot of the first shelf-supporting connector interlocks with the first slot of the first rung of the first side piece and the second angled slot of the first shelf-supporting connector interlocks with the first slot of the first rung of the second side piece. The first angled slot of the second shelf-supporting connector interlocks with the first slot of the second rung of the first side piece and the second angled slot of the second shelf-supporting connector interlocks with the first slot of the second rung of the second side piece. The shelf unit further includes a first top connector attaching with the third rungs of the first and second side pieces, the first top connector including first and second angled slots. The first angled slot of the first top connector is angled acutely relative to the shelves at the first angle and interlocks with the first slot of the third rung of the first side piece, and the second angled slot of the first top connector is angled acutely relative to the shelves at the second angle and interlocks with the first slot of the third rung of the second side piece. The first shelf is positioned atop the first shelf-supporting connector and the second shelf is positioned atop the second shelf-supporting connector.

In another embodiment, the first and second rungs each include a second slot, and the shelf unit further includes third and fourth shelf-supporting connectors, the third shelf-supporting connector attaching with the first rungs of the first and second side pieces and the fourth shelf-supporting connector attaching with the second rungs of the first and second side pieces. The third and fourth shelf-supporting connectors each include first and second angled slots, wherein the first angled slots are each angled acutely relative to the shelves at the first angle and the second angled slots are each angled acutely relative to the shelves at the second angle. The first angled slot of the third shelf-supporting connector interlocks with the second slot of the first rung of the first side piece and the second angled slot of the third shelf-supporting connector interlocks with the second slot of the first rung of the second side piece. The first angled slot of the fourth shelf-supporting connector interlocks with the second slot of the second rung of the first side piece and the second angled slot of the fourth shelf-supporting connector interlocks with the second slot of the second rung of the second side piece. The first shelf is positioned atop the third shelf-supporting connector and the second shelf is positioned atop the fourth shelf-supporting connector.

In another embodiment, the third rung includes a second slot, and the shelf unit further includes a second top connector attaching with the third rungs of the first and second side pieces, the second top connector including first and second angled slots. The first angled slot of the second top connector is angled acutely relative to the shelves at the first angle and interlocks with the second slot of the third rung of the first side piece, and the second angled slot of the second top connector is angled acutely relative to the shelves at the second angle and interlocks with the second slot of the third rung of the second side piece.

In yet another embodiment, the first and second angles are each between 45 degrees and 80 degrees.

In still another embodiment, the first and second angles are equal to each other.

Various additional objectives, advantages, and features of the invention will be appreciated from a review of the following detailed description of the illustrative embodiments taken in conjunction with the accompanying drawings.

BRIEF DESCRIPTION

DETAILED DESCRIPTION

Figure 1:
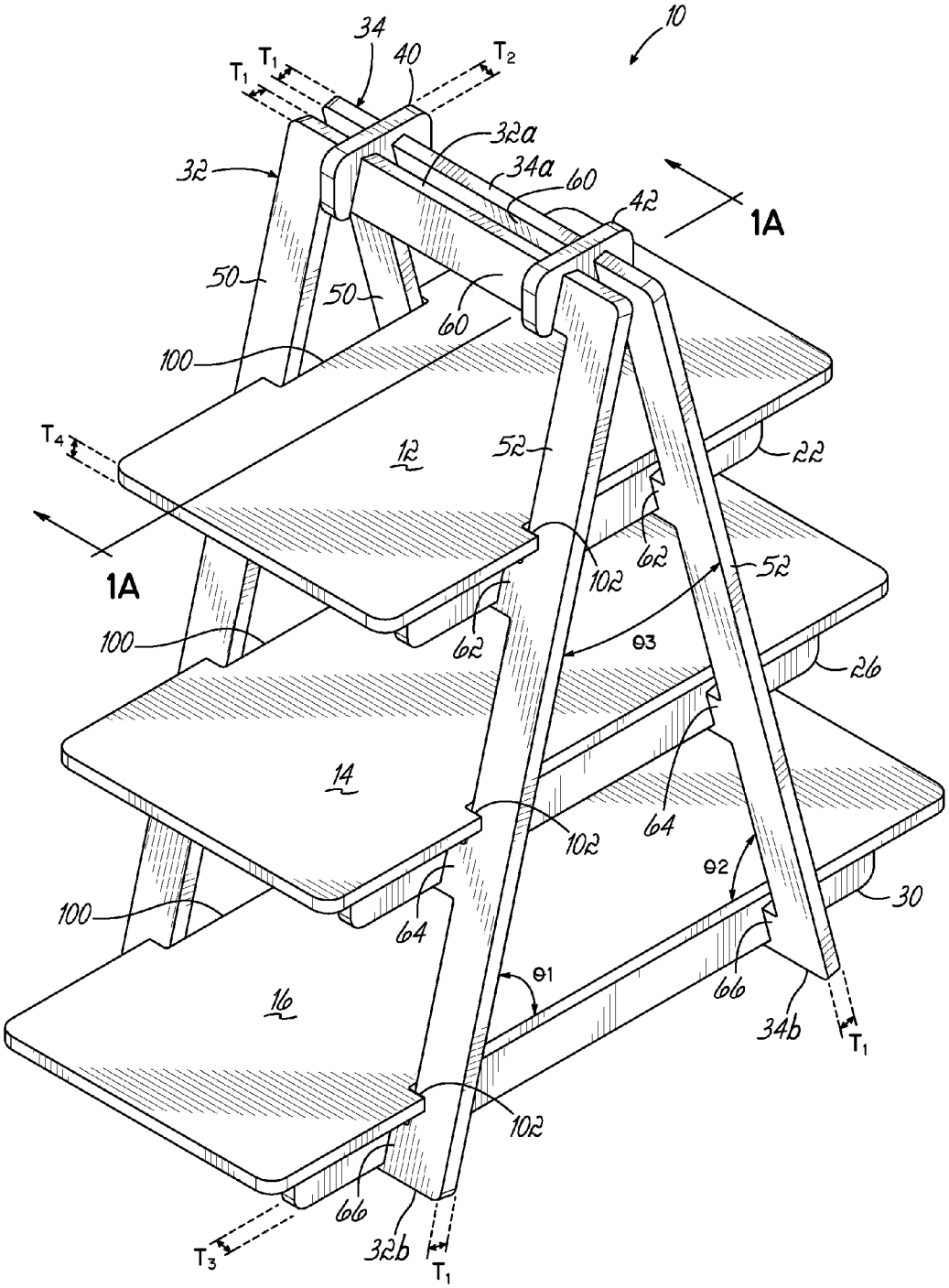
FIG. 1 is a perspective view of a shelf unit in accordance with one embodiment of the invention.
Figure 1A:
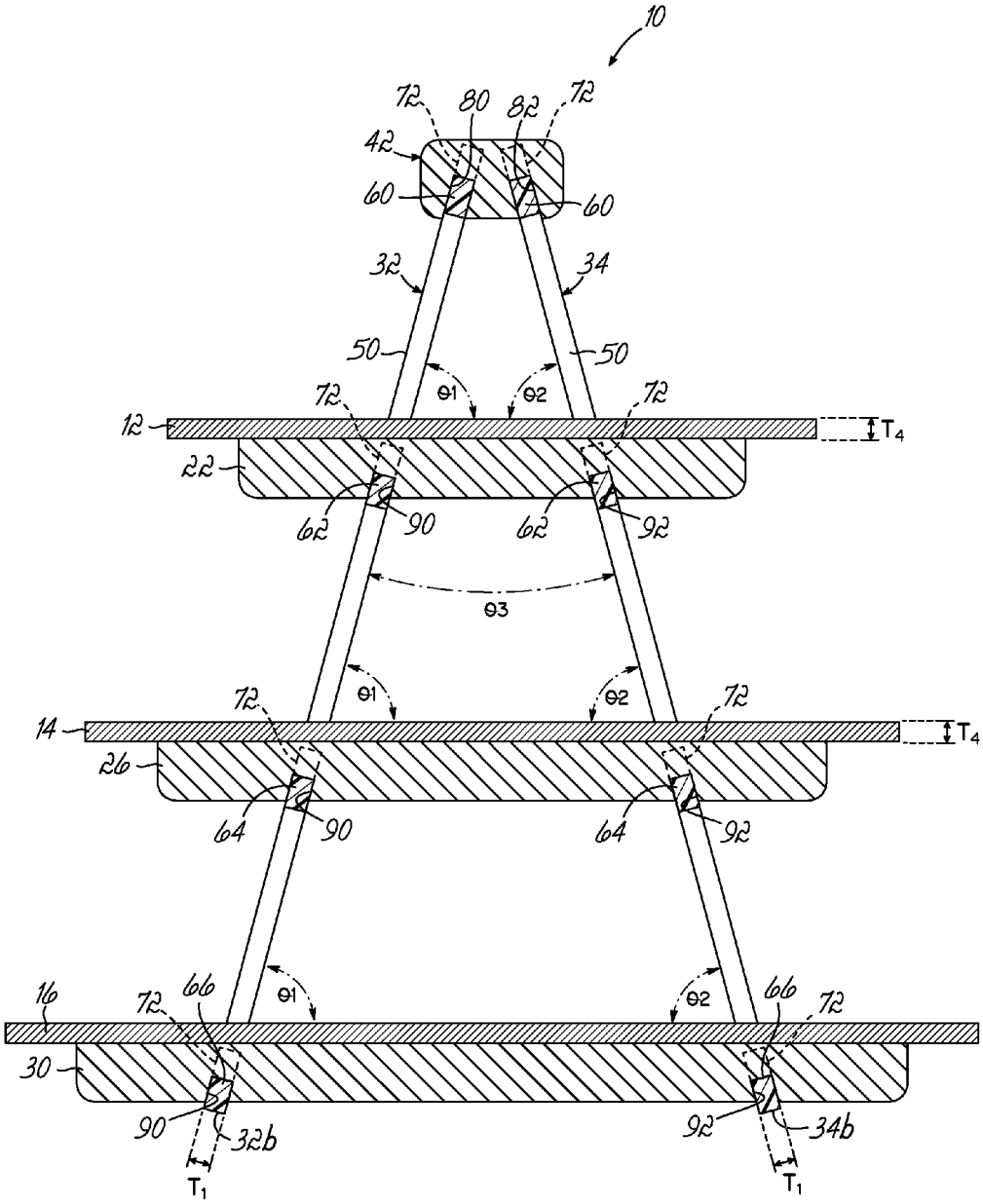
FIG. 1A is a cross-sectional view of the shelf unit of FIG. 1 taken along line 1A-1A.

With respect to FIGS. 1 and 1A, a shelf unit 10 eliminates the need for hardware components. Specifically, the shelf unit 10 has a modular, interlocking design, and may therefore be assembled without requiring nails, screws, or other hardware components. The shelf unit 10 includes horizontally oriented shelves 12, 14, 16 supported on shelf-supporting connectors 20, 22, 24, 26, 28, 30 which are, in turn, supported on first and second side pieces 32, 34. While the embodiment shown includes top, middle, and bottom shelves 12, 14, 16, other shelf units may include any number of shelves as may be desired. For example, a shelf unit may include only top and bottom shelves 12, 16, or may include any number of additional shelves.

The shelf unit 10 is vertically supported by first and second side pieces 32, 34, each including a top 32*a*, 34*a* and a bottom 32*b*, 34*b*. As shown, the first side piece 32 is angled acutely relative to the shelves 12, 14, 16 at a first angle θ1, and the second side piece 34 is angled acutely relative to the shelves 12, 14, 16 and toward the first side piece 32 at a second angle θ2. In this manner, the tops 32*a*, 34*a* of the first and second side pieces 32, 34 are adjacent to each other, so that the tops 32*a*, 34*a* may be attached to each other by first and second top connectors 40, 42, described in more detail below. The first and second angles θ1, θ2 may each be between approximately 45 degrees and approximately 80 degrees. For example, at least one of the first or second angles θ1, θ2 may be approximately 60 degrees. In one embodiment, the first and second angles θ1, θ2 are substantially equal to each other. For example, the first and second angles θ1, θ2 may each be approximately 60 degrees.

In the embodiment shown, the first and second side pieces 32, 34 are angled relative to each other at a third angle θ3. In one embodiment, the first, second, and third angles θ1, θ2, θ3 may be said to define the internal angles of a triangular cross section of the shelf unit 10, such that the sum of the first, second, and third angles θ1, θ2, θ3 is equal to 180 degrees.

Figure 2:
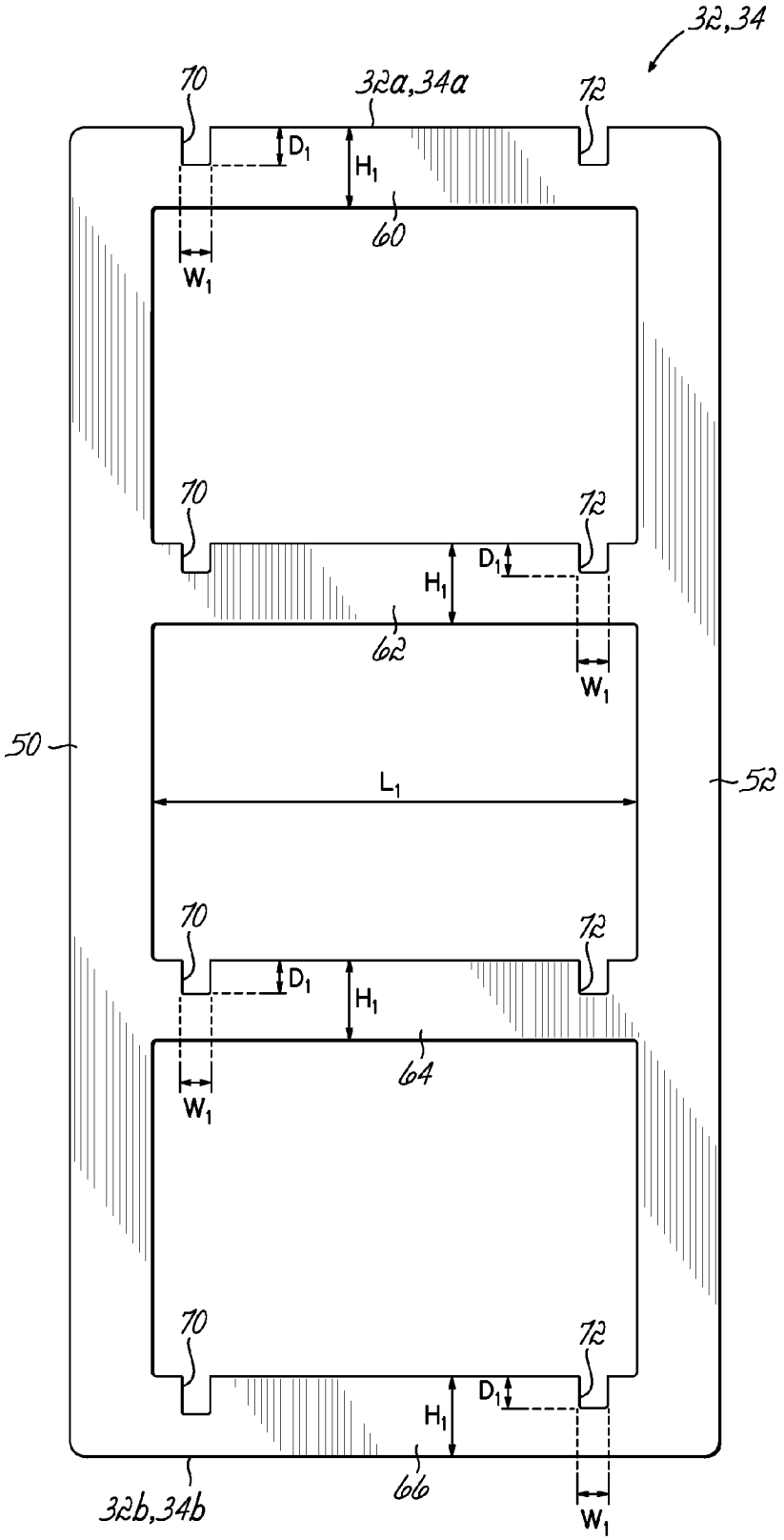
FIG. 2 is a front view of a side piece of the shelf unit of FIG. 1.

Referring now to FIG. 2, with continued reference to FIGS. 1 and 1A, each of the first and second side pieces 32, 34 includes a first rail 50 and a second rail 52 and a plurality of rungs 60, 62, 64, 66 extending between the first rail 50 and the second rail 52. As shown, each plurality of rungs may include a top rung 60, intermediate rungs 62, 64, and a bottom rung 66. While the embodiment shown includes four rungs 60, 62, 64, 66, other shelf units may include any number of rungs as may be desired. In one embodiment, the number of rungs of each of the side pieces may be one more than the number of shelves of the shelf unit 10.

Each of the rungs 60, 62, 64, 66 extends between the first and second rails 50, 52 at a length L1 with a height H1 and a thickness T1, and includes first and second slots 70, 72. As shown, each of the first and second slots 70, 72 may be positioned proximate the first and second rails 50, 52, respectively, and may extend from an upper surface of each rung 60, 62, 64, 66 into the body of each rung at a depth D1 with a width W1. In one embodiment, each of the slots 70, 72 extends at a depth D1 approximately halfway through the body of each rung 60, 62, 64, 66. In other words, the depth D1 of the slots 70, 72 may be equal to approximately half of the height H1 of the rungs 60, 62, 64, 66. In the embodiment shown, the slots 70, 72 of each of the rungs 60, 62, 64, 66 have a uniform depth D1 and a uniform width W1. Alternatively, the depths D1 and widths W1 of each of the slots 70, 72 may vary depending on the particular application. Moreover, while the embodiment shown includes first and second slots 70, 72 in each of the rungs 60, 62, 64, 66, other embodiments may include only a single slot in one or more of the rungs. For example, in one embodiment, a single slot (not shown) may be positioned centrally along each of the rungs. Other alternative embodiments may include any number of additional slots, for reasons described more fully below. For example, in one embodiment, a centrally positioned slot (not shown) may be provided in addition to the previously mentioned first and second slots 70, 72.

Figure 3:
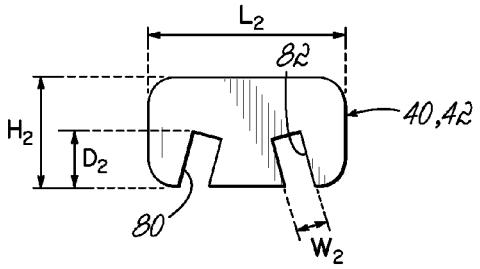
FIG. 3 is a front view of a top connector of the shelf unit of FIG. 1.
Figure 4:
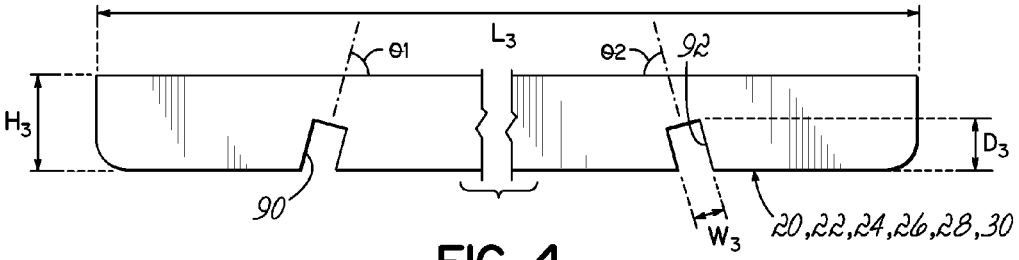
FIG. 4 is a front view of a shelf-supporting connector of the shelf unit of FIG. 1.

With continued reference to FIGS. 1, 1A, and 2, and also referring now to FIGS. 3 and 4, the first and second side pieces 32, 34 are coupled together by a plurality of connectors, including first and second top connectors 40, 42 (FIG. 3) and a plurality of shelf-supporting connectors 20, 22, 24, 26, 28, 30 (FIG. 4). As shown in FIG. 1, the first and second top connectors 40, 42 each attach with the top rungs 60 of the first and second side pieces 32, 34, respectively. To this end, the first and second top connectors 40, 42 are generally rectangularly shaped, each having a length L2, a height H2, and a thickness T2, and each include first and second angled slots 80, 82. As shown, the first and second angled slots 80, 82 may extend from a lower surface of each top connector 40, 42 into the body of each top connector at a depth D2 with a width W2. The first angled slot 80 of each top connector 40, 42 is angled acutely relative to the shelves 12, 14, 16 at the first angle θ1 and the second angled slot 82 is angled acutely relative to the shelves 12, 14, 16 at the second angle θ2 (FIG. 1A). In the embodiment shown, the first angled slot 80 of the first top connector 40 interlocks with the first slot 70 of the top rung 60 of the first side piece 32 and the second angled slot 82 of the first top connector 40 interlocks with the first slot 70 of the top rung 60 of the second side piece 34. Likewise, the first angled slot 80 of the second top connector 42 interlocks with the second slot 72 of the top rung 60 of the first side piece 32 and the second angled slot 82 of the second top connector 42 interlocks with the second slot 72 of the top rung 60 of the second side piece 34.

In order to facilitate the interlocking of the angled slots 80, 82 of the top connectors 40, 42 with the slots 70, 72 of the top rungs 60, the width W1 of each slot 70, 72 of the top rungs 60 may be substantially equal to the thickness T2 of the respective top connector 40, 42 to be interlocked therewith. Likewise, the width W2 of each angled slot 80, 82 of the top connectors 40, 42 may be substantially equal to the thickness T1 of the respective top rung 60 to be interlocked therewith. In one embodiment, the thicknesses T1, T2 of the top rungs 60 and top connectors 40, 42 may be substantially equal to each other, such that the widths W1 of the slots 70, 72 of the top rungs 60 are substantially equal to the widths W2 of the angled slots 80, 82 of the top connectors 40, 42.

In one embodiment, the depth D1 of each slot 70, 72 of the top rungs 60 is substantially equal to the difference between the height H2 of the respective top connector 40, 42 and the depth D2 of the respective angled slot 80, 82, and the depth D2 of each angled slot 80, 82 of the top connectors 40, 42 is substantially equal to the difference between the height H1 of the respective top rung 60 and the depth D1 of the respective slot 70, 72. In this manner, top and bottom portions of each top rung 60 may be substantially flush with the top and bottom surfaces, respectively, of each respective top connector 40, 42.

In an alternative embodiment, each of the top rungs 60 may only include a single slot such as, for example, a centrally positioned slot (not shown). In such an embodiment, only a first top connector 40 may be employed so that the second top connector 42 may be eliminated. Specifically, the first angled slot 80 of the first top connector 40 may interlock with the slot of the top rung 60 of the first side piece 32, while the second angled slot 82 may interlock with the slot of the top rung 60 of the second side piece 34.

Alternatively, each of the top rungs 60 may include any number of additional slots for receiving additional top connectors 40, 42 in order to improve the stability of the shelf unit 10. For example, each of the top rungs 60 may include first and second slots 70, 72, as previously shown and described, as well as a centrally positioned slot, so that three top connectors may be used. In any event, the top connector(s) couple the tops 32*a*, 34*a* of the first and second side pieces 32, 34 such that the top rungs 60 are adjacent each other while the bottom rungs 66 are spaced apart from each other, as shown. In one embodiment, the bottom rungs 66 may support the shelf unit 10 on a surface such as, for example, a floor, tabletop, countertop, or the like.

The shelf-supporting connectors 20, 22, 24, 26, 28, 30 each attach with various rungs 62, 64, 66 of the first and second side pieces 32, 34. Specifically, the first and second upper shelf-supporting connectors 20, 22 each attach with the intermediate rungs 62 of the first and second side pieces 32, 34; the first and second middle shelf-supporting connectors 24, 26 each attach with the intermediate rungs 64 of the first and second side pieces 32, 34; and the first and second lower shelf-supporting connectors 28, 30 each attach with the bottom rungs 66 of the first and second side pieces 32, 34. To this end, and as shown in FIG. 4, the shelf-supporting connectors 20, 22, 24, 26, 28, 30 are generally rectangularly shaped, each having a length L3, a height H3, and a thickness T3, and each include first and second angled slots 90, 92. As shown, the first and second angled slots 90, 92 may extend from a lower surface of each shelf-supporting connector 20, 22, 24, 26, 28, 30 into the body of each shelf-supporting connector at a depth D3 with a width W3. The first angled slot 90 of each shelf-supporting connector 20, 22, 24, 26, 28, 30 is angled acutely relative to the shelves 12, 14, 16 at the first angle θ1 and the second angled slot 92 is angled acutely relative to the shelves 12, 14, 16 at the second angle θ2 (FIG. 1A). In the embodiment shown, the first angled slot 90 of the first upper shelf-supporting connector 20 interlocks with the first slot 70 of the intermediate rung 62 of the first side piece 32 and the second angled slot 92 of the first upper shelf-supporting connector 20 interlocks with the first slot 70 of the intermediate rung 62 of the second side piece 34. Likewise, the first angled slot 90 of the second upper shelf-supporting connector 22 interlocks with the second slot 72 of the intermediate rung 62 of the first side piece 32 and the second angled slot 92 of the second upper shelf-supporting connector 22 interlocks with the second slot 72 of the intermediate rung 62 of the second side piece 34.

In a similar fashion, the first angled slot 90 of the first middle shelf-supporting connector 24 interlocks with the first slot 70 of the intermediate rung 64 of the first side piece 32 and the second angled slot 92 of the first middle shelf-supporting connector 24 interlocks with the first slot 70 of the intermediate rung 64 of the second side piece 34. Likewise, the first angled slot 90 of the second middle shelf-supporting connector 26 interlocks with the second slot 72 of the intermediate rung 64 of the first side piece 32 and the second angled slot 92 of the second middle shelf-supporting connector 26 interlocks with the second slot 72 of the intermediate rung 64 of the second side piece 34.

Similarly, the first angled slot 90 of the first lower shelf-supporting connector 28 interlocks with the first slot 70 of the bottom rung 66 of the first side piece 32 and the second angled slot 92 of the first lower shelf-supporting connector 28 interlocks with the first slot 70 of the bottom rung 66 of the second side piece 34. Likewise, the first angled slot 90 of the second lower shelf-supporting connector 30 interlocks with the second slot 72 of the bottom rung 66 of the first side piece 32 and the second angled slot 92 of the second lower shelf-supporting connector 30 interlocks with the second slot 72 of the bottom rung 66 of the second side piece 34.

The interlocking of the angled slots 90, 92 of the shelf-supporting connectors 20, 22, 24, 26, 28, 30 with the slots 70, 72 of the rungs 62, 64, 66 may be facilitated in a manner similar to the interlocking of the angled slots 80, 82 of the top connectors 40, 42 with the slots 70, 72 of the top rungs 60. Specifically, the width W1 of each slot 70, 72 of the rungs 62, 64, 66 may be substantially equal to the thickness T3 of the respective shelf-supporting connector 20, 22, 24, 26, 28, 30 to be interlocked therewith. Likewise, the width W3 of each angled slot 90, 92 of the shelf-supporting connectors 20, 22, 24, 26, 28, 30 may be substantially equal to the thickness T1 of the respective rung 62, 64, 66 to be interlocked therewith. In one embodiment, the thicknesses T1, T3 of the rungs 62, 64, 66 and shelf-supporting connectors 20, 22, 24, 26, 28, 30 may be substantially equal to each other, such that the widths W1 of the slots 70, 72 of the rungs 62, 64, 66 may be substantially equal to the widths W3 of the angled slots 90, 92 of the shelf-supporting connectors 20, 22, 24, 26, 28, 30.

In one embodiment, the depth D1 of each slot 70, 72 of the rungs 62, 64, 66 may be substantially equal to the difference between the height H3 of the respective shelf-supporting connector 20, 22, 24, 26, 28, 30 and the depth D3 of the respective angled slot 90, 92, and the depth D3 of each angled slot 90, 92 of the shelf-supporting connectors 20, 22, 24, 26, 28, 30 may be substantially equal to the difference between the height H1 of the respective rung 62, 64, 66 and the depth D1 of the respective slot 70, 72. In this manner, top and bottom portions of each rung 62, 64, 66 may be substantially flush with the top and bottom surfaces, respectively, of each respective shelf-supporting connector 20, 22, 24, 26, 28, 30.

Figure 5:
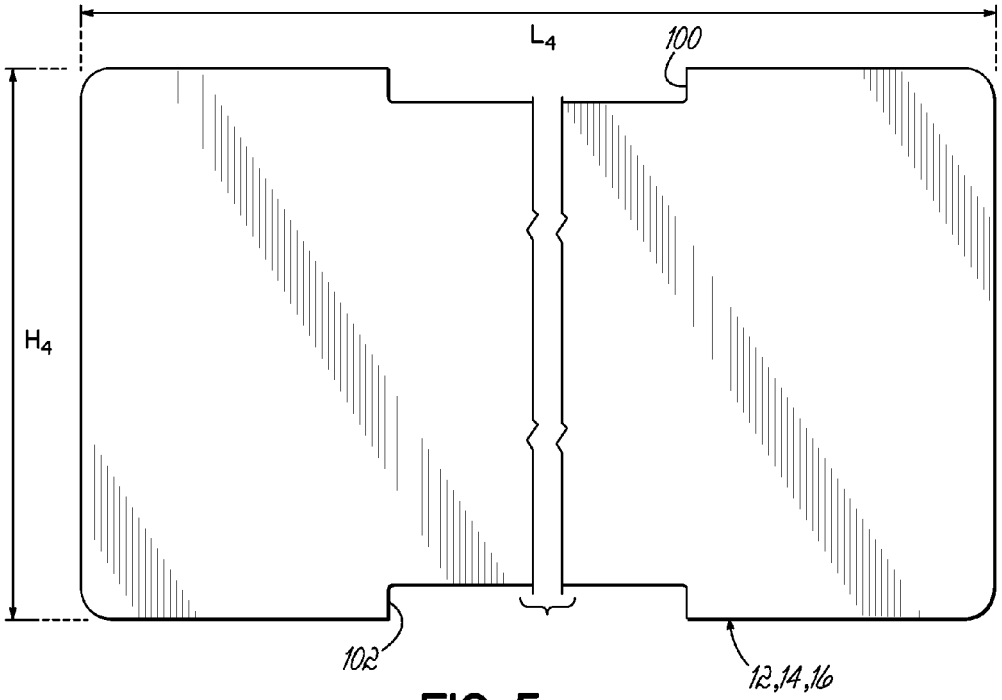
FIG. 5 is a top view of a shelf of the shelf unit of FIG. 1.

The lengths L3 of each of the shelf-supporting connectors 20, 22, 24, 26, 28, 30 may be selected based on the lengths L4 of the respective shelves 12, 14, 16 to be supported thereon (FIG. 5). For example, the lengths L3 of the first and second upper shelf-supporting connectors 20, 22 may be selected based on the length L4 of the top shelf 12, the lengths L3 of the first and second middle shelf-supporting connectors 24, 26 may be selected based on the length L4 of the middle shelf 14, and the lengths L3 of the first and second lower shelf-supporting connectors 28, 30 may be selected based on the length L4 of the bottom shelf 16. In one embodiment, the lengths L3 of each of the shelf-supporting connectors 20, 22, 24, 26, 28, 30 may be selected in order to provide maximum support and/or maximum anti-tipping characteristics to the shelves 12, 14, 16. In the embodiment shown, the lengths L3 of each of the shelf-supporting connectors 20, 22, 24, 26, 28, 30 may be slightly less than the length L4 of their respective shelves 12, 14, 16, so as to provide both maximum support and maximum anti-tipping characteristics to the shelves 12, 14, 16 while minimizing the amount of material required for the shelf-supporting connectors 20, 22, 24, 26, 28, 30.

In an alternative embodiment, the shelf unit 10 may only include top and bottom shelves 12, 16, such that the first and second middle shelf-supporting connectors 24, 26 may be dispensed with.

It will be appreciated that proper stability of each shelf 12, 14, 16 may be achieved by utilizing first and second shelf-supporting connectors to support each of the shelves as previously shown and described. However, in another alternative embodiment, each of the intermediate and bottom rungs 62, 64, 66 may only include a single slot such as, for example, a centrally positioned slot (not shown). In such an embodiment, only first upper, middle, and lower shelf-supporting connectors 20, 24, 28 may be employed, such that the second upper, middle, and lower shelf-supporting connectors 22, 26, 30 may be dispensed with. Specifically, the first angled slot 90 of the first upper shelf-supporting connector 20 may interlock with the slot of the intermediate rung 62 of the first side piece 32, while the second angled slot 92 of the first upper shelf-supporting connector 20 may interlock with the slot of the intermediate rung 62 of the second side piece 34; the first angled slot 90 of the first middle shelf-supporting connector 24 may interlock with the slot of the intermediate rung 64 of the first side piece 32, while the second angled slot 92 of the first middle shelf-supporting connector 24 may interlock with the slot of the intermediate rung 64 of the second side piece 34; and the first angled slot 90 of the first lower shelf-supporting connector 28 may interlock with the slot of the bottom rung 66 of the first side piece 32, while the second angled slot 92 of the first lower shelf-supporting connector 28 may interlock with the slot of the bottom rung 66 of the second side piece 34.

In such an embodiment, the first upper, middle, and lower shelf-supporting connectors 20, 24, 28 may each be configured to fully support a shelf 12, 14, 16. For example, the thickness T3 of each shelf-supporting connector 20, 24, 28 may be sufficiently large to support a shelf 12, 14, 16 with minimal risk of tipping. In addition or alternatively, each shelf-supporting connector 20, 24, 28 may comprise a cross-sectional shape suitable for independently carrying a shelf 12, 14, 16 on its upper surface. Examples of such cross-sectional shapes include, but are not limited to, a T-shaped cross-section, an I-shaped cross-section, or an inverse triangular cross-section. In one embodiment, upper portions of the rungs 62, 64, 66 of the side pieces 32, 34 may be substantially flush with the upper surfaces of the shelf-supporting connectors 20, 24, 28, and the upper portions of the rungs 62, 64, 66 may provide additional support and stability to the shelves 12, 14, 16.

Alternatively, each of the intermediate and bottom rungs 62, 64, 66 may include any number of additional slots for receiving additional shelf-supporting connectors in order to improve the stability of the shelf unit 10. For example, each of the intermediate and bottom rungs 62, 64, 66 may include first and second slots 70, 72, as previously shown and described, as well as a centrally positioned slot, so that three shelf-supporting connectors may be used to support each shelf 12, 14, 16.

Referring now to FIG. 5, with continued reference to FIGS. 1 and 1A, each shelf 12, 14, 16 may have a flat, generally rectangular configuration with a length L4, a height H4, and a thickness T4. In the embodiment shown, the height H4 of each shelf 12, 14, 16 is slightly greater than the distance between the rails 50, 52, or the length L1 of the rungs 60, 62, 64, 66 of each of the side pieces 32, 34. However, each shelf 12, 14, 16 includes first and second recesses 100, 102 positioned on sides of the shelf adjacent to the side pieces 32, 34 (FIG. 1). The first and second recesses 100, 102 of a shelf 12, 14, 16 may each receive, or engage with, a portion of at least one of the first or second side pieces 32, 34 such as, for example, a portion of a rail 50, 52, so as to retain the shelf 12, 14, 16 in place. In this manner, the engagement between the recess 100, 102 and the side pieces 32, 34 may prevent the shelf 12, 14, 16 from sliding or otherwise undesirably shifting along the respective shelf-supporting connectors 20, 22, 24, 26, 28, 30. Alternatively, the height H4 of each shelf 12, 14, 16 may be substantially equal to or less than the distance between the rails 50, 52, or the length L1 of the rungs 60, 62, 64, 66 of the side pieces 32, 34. In such an embodiment, the shelves 12, 14, 16 may be freely shifted along their respective shelf-supporting connectors 20, 22, 24, 26, 28, 30.

In the embodiment shown, the length L4 of each shelf 12, 14, 16 may be selected based on the position of the shelf relative to the remaining shelves. For example, the length L4 of the top shelf 12 may be the smallest, while the length L4 of the bottom shelf 16 may be the greatest, as may be desired. Alternatively, the length L4 of each shelf 12, 14, 16 may be selected based on other factors. In one embodiment, for example, the shelves 12, 14, 16 may each have the same length L4.

Since the shelf unit 10 does not require any nails, screws, or other hardware components, the minimum thickness requirements of the shelves, side pieces, and connectors are dictated only by a target load capacity of the shelf unit 10. Therefore, the thicknesses T1, T2, T3, T4 of the side pieces 32, 34, top connectors 40, 42, shelf-supporting connectors 20, 22, 24, 26, 28, 30, and shelves 12, 14, 16 may be relatively small in comparison to the shelves and supports of conventional shelf units. Thus, the shelf unit 10 may advantageously require less material than conventional shelf units. In one embodiment, the thicknesses T1, T2, T3, T4 of the side pieces 32, 34, top connectors 40, 42, shelf-supporting connectors 20, 22, 24, 26, 28, 30, and shelves 12, 14, 16 may be substantially equal to each other, so as to simplify manufacturing processes.

Figure 6A:
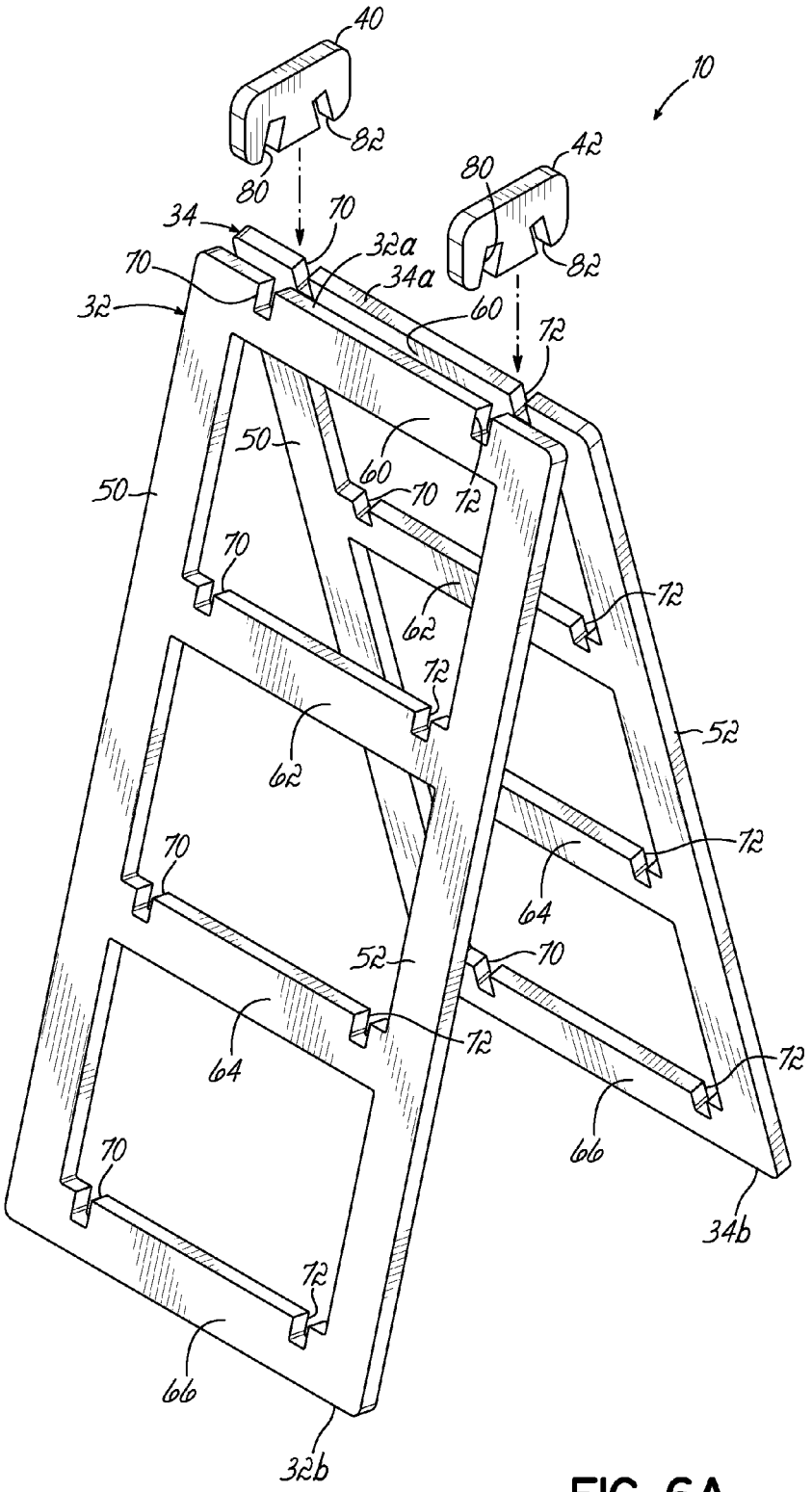
FIGS. 6A-6C are perspective views showing a method of assembling the shelf unit of FIG. 1.
Figure 6B:
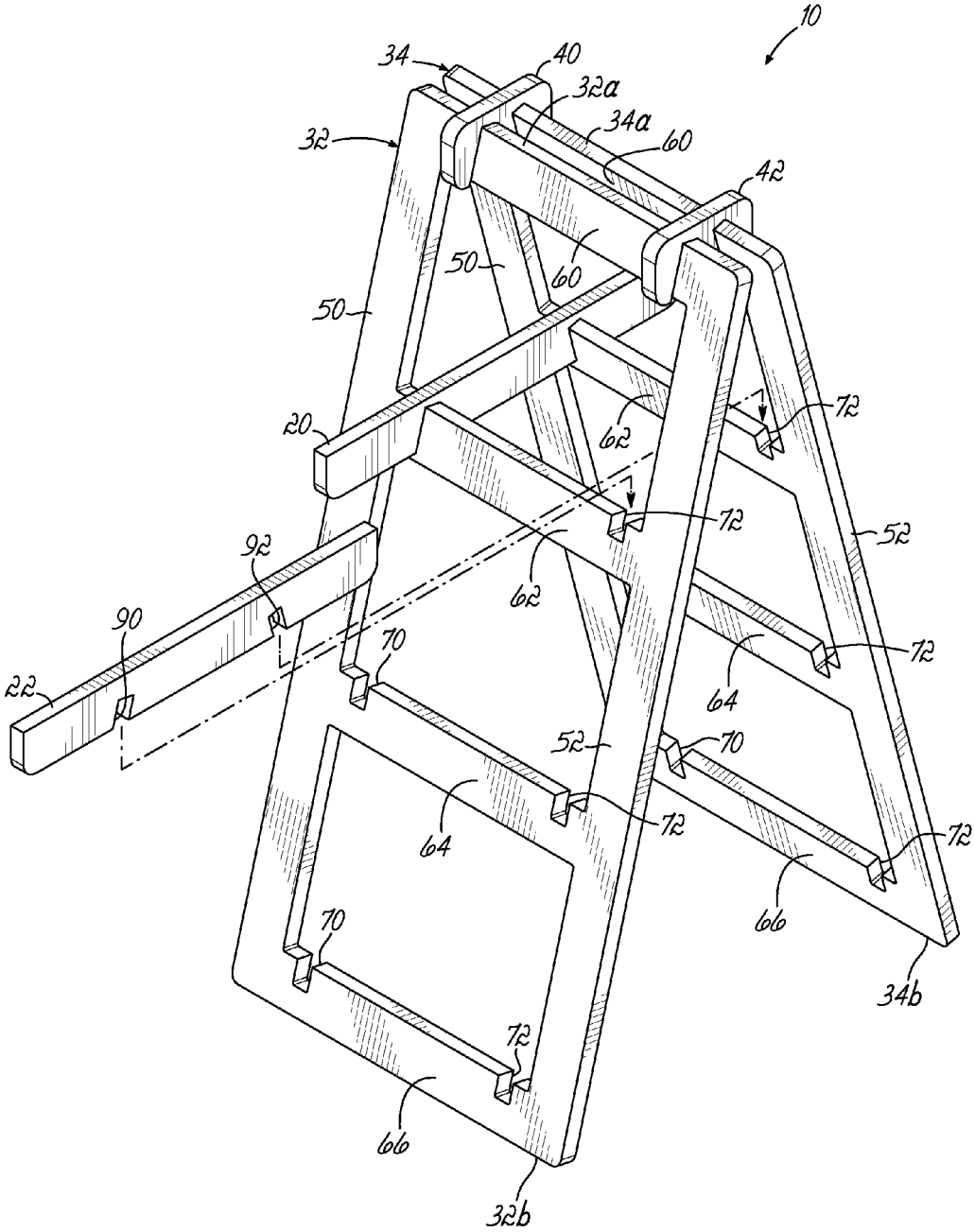
Figure 6C:
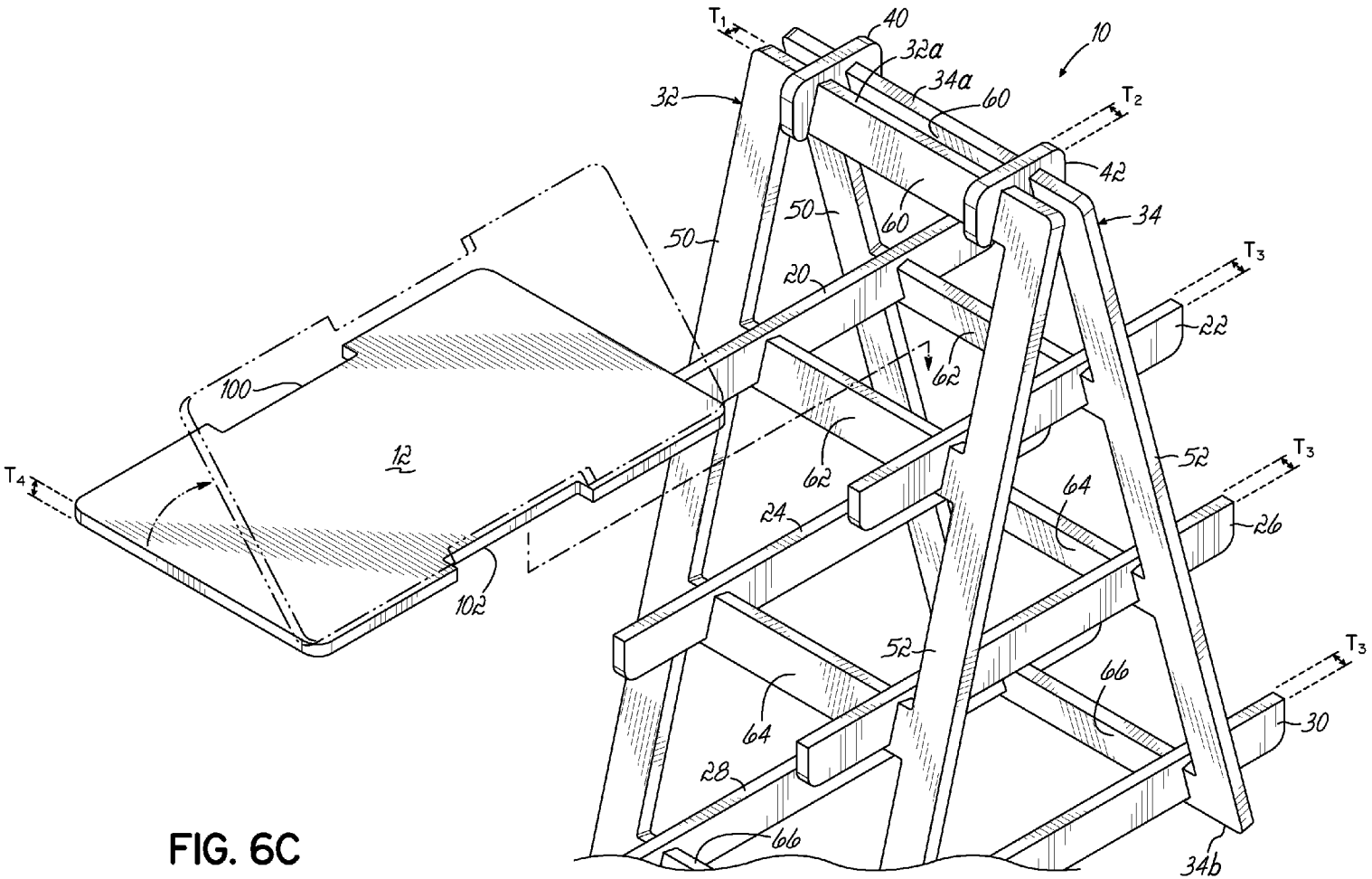

Turning now to FIGS. 6A-6C, a method of assembling a shelf unit 10 in accordance with the principles of the present invention will now be described. As shown in FIG. 6A, first and second side pieces 32, 34 may be arranged such that the tops 32*a*, 34*a* of the side pieces are adjacent each other and the bottoms 32*b*, 34*b* of the side pieces are spaced apart from each other, as shown. First and second top connectors 40, 42 may then each be attached to the first and second side pieces 32, 34 so as to couple the first and second side pieces together. In the embodiment shown, this is achieved by interlocking the first angled slot 80 of the first top connector 40 with the first slot 70 of the top rung 60 of the first side piece 32 and interlocking the second angled slot 82 of the first top connector 40 with the first slot 70 of the top rung 60 of the second side piece 34. Likewise, the first angled slot 80 of the second top connector 42 is interlocked with the second slot 72 of the top rung 60 of the first side piece 32 and the second angled slot 82 of the second top connector 42 is interlocked with the second slot 72 of the top rung 60 of the second side piece 34.

With the top connectors 40, 42 in place, the shelf unit 10 may be generally free-standing. Next, various shelf-supporting connectors 20, 22, 24, 26, 28, 30 may also each be attached to the first and second side pieces 32, 34 to further stabilize the shelf unit 10. As shown in FIG. 6B, the first angled slot 90 of the first upper shelf-supporting connector 20 is interlocked with the first slot 70 of the intermediate rung 62 of the first side piece 32 and the second angled slot 92 of the first upper shelf-supporting connector 20 is interlocked with the first slot 70 of the intermediate rung 62 of the second side piece 34. Likewise, the first angled slot 90 of the second upper shelf-supporting connector 22 is interlocked with the second slot 72 of the intermediate rung 62 of the first side piece 32 and the second angled slot 92 of the second upper shelf-supporting connector 22 is interlocked with the second slot 72 of the intermediate rung 62 of the second side piece 34. This process may then be repeated with respect to the middle shelf-supporting connectors 24, 26. Specifically, the first angled slot 90 of the first middle shelf-supporting connector 24 is interlocked with the first slot 70 of the intermediate rung 64 of the first side piece 32 and the second angled slot 92 of the first middle shelf-supporting connector 24 is interlocked with the first slot 70 of the intermediate rung 64 of the second side piece 34. Likewise, the first angled slot 90 of the second middle shelf-supporting connector 26 is interlocked with the second slot 72 of the intermediate rung 64 of the first side piece 32 and the second angled slot 92 of the second middle shelf-supporting connector 26 is interlocked with the second slot 72 of the intermediate rung 64 of the second side piece 34. This process may then again be repeated with respect to the lower shelf-supporting connectors 28, 30. Specifically, the first angled slot 90 of the first lower shelf-supporting connector 28 is interlocked with the first slot 70 of the bottom rung 66 of the first side piece 32 and the second angled slot 92 of the first lower shelf-supporting connector 28 is interlocked with the first slot 70 of the bottom rung 66 of the second side piece 34. Likewise, the first angled slot 90 of the second lower shelf-supporting connector 30 is interlocked with the second slot 72 of the bottom rung 66 of the first side piece 32 and the second angled slot 92 of the second lower shelf-supporting connector 30 is interlocked with the second slot 72 of the bottom rung 66 of the second side piece 34.

With the shelf-supporting connectors 20, 22, 24, 26, 28, 30 in place, the shelf unit 10 may be well stabilized and suitable for supporting shelves 12, 14, 16 and goods to be placed thereon. Thus, as shown in FIG. 6C, each of the shelves 12, 14, 16 may be rotated from a horizontal orientation to an angled orientation and inserted between the rails 50, 52 of the first and second side pieces 32, 34, respectively, over their respective shelf-supporting connectors 20, 22, 24, 26, 28, 30. In one embodiment, each of the shelves 12, 14, 16 may be rotated at an angle of approximately 45 degrees. This rotating may enable the shelves 12, 14, 16 to clear the rails 50, 52 and adjacent rungs 60, 62, 64, 66 while being inserted into place in embodiments in which the height H4 of the shelves is greater than the distance between the rails 50, 52, or the length L1 of the rungs 60, 62, 64, 66 of the side pieces 32, 34. In such embodiments, once the recesses 100, 102 of a shelf 12, 14, 16 are aligned to receive their respective side piece 32, 34, the shelf may be returned to a horizontal orientation and lowered onto the respective shelf-supporting connectors 20, 22, 24, 26, 28, 30 to complete assembly (FIG. 1). By eliminating the need for hardware components, the assembly of the shelf unit 10 is relatively quick and simple.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A shelf unit comprising:

first and second shelves, each oriented horizontally;

first and second side pieces, each including a top and a bottom, the first and second side pieces each including first and second rails and first, second, and third rungs extending between the first and second rails, the third rungs being adjacent the tops, and the first, second, and third rungs each including a first slot, wherein the first side piece is angled acutely relative to the shelves at a first angle and the second side piece is angled acutely relative to the shelves and toward the first side piece at a second angle such that the tops of the first and second side pieces are adjacent to each other;

first and second shelf-supporting connectors, the first shelf-supporting connector attaching with the first rungs of the first and second side pieces and the second shelf-supporting connector attaching with the second rungs of the first and second side pieces, the first and second shelf-supporting connectors each including first and second angled slots, wherein the first angled slots are each angled acutely relative to the shelves at the first angle and the second angled slots are each angled acutely relative to the shelves at the second angle, wherein the first angled slot of the first shelf-supporting connector interlocks with the first slot of the first rung of the first side piece and the second angled slot of the first shelf-supporting connector interlocks with the first slot of the first rung of the second side piece, and wherein the first angled slot of the second shelf-supporting connector interlocks with the first slot of the second rung of the first side piece and the second angled slot of the second shelf-supporting connector interlocks with the first slot of the second rung of the second side piece; and a first top connector attaching with the third rungs of the first and second side pieces, the first top connector including first and second angled slots, wherein the first angled slot of the first top connector is angled acutely relative to the shelves at the first angle and interlocks with the first slot of the third rung of the first side piece, and the second angled slot of the first top connector is angled acutely relative to the shelves at the second angle and interlocks with the first slot of the third rung of the second side piece;

wherein the first shelf is positioned atop the first shelf-supporting connector and the second shelf is positioned atop the second shelf-supporting connector.

2. The shelf unit of claim 1, wherein the first and second rungs each include a second slot, the shelf unit further comprising:

third and fourth shelf-supporting connectors, the third shelf-supporting connector attaching with the first rungs of the first and second side pieces and the fourth shelf-supporting connector attaching with the second rungs of the first and second side pieces, the third and fourth shelf-supporting connectors each including first and second angled slots, wherein the first angled slots are each angled acutely relative to the shelves at the first angle and the second angled slots are each angled acutely relative to the shelves at the second angle, wherein the first angled slot of the third shelf-supporting connector interlocks with the second slot of the first rung of the first side piece and the second angled slot of the third shelf-supporting connector interlocks with the second slot of the first rung of the second side piece, and wherein the first angled slot of the fourth shelf-supporting connector interlocks with the second slot of the second rung of the first side piece and the second angled slot of the fourth shelf-supporting connector interlocks with the second slot of the second rung of the second side piece;

wherein the first shelf is positioned atop the third shelf-supporting connector and the second shelf is positioned atop the fourth shelf-supporting connector.

3. The shelf unit of claim 1, wherein the third rung includes a second slot, the shelf unit further comprising a second top connector attaching with the third rungs of the first and second side pieces, the second top connector including first and second angled slots, wherein the first angled slot of the second top connector is angled acutely relative to the shelves at the first angle and interlocks with the second slot of the third rung of the first side piece, and the second angled slot of the second top connector is angled acutely relative to the shelves at the second angle and interlocks with the second slot of the third rung of the second side piece.

4. The shelf unit of claim 1, wherein the first and second side pieces each further include fourth rungs extending between the first and second rails, the fourth rungs each including a first slot, the shelf unit further comprising:

a third shelf, oriented horizontally; and a third shelf-supporting connector attaching with the fourth rungs of the first and second side pieces, the third shelf-supporting connector including first and second angled slots, wherein the first angled slot of the third shelf-supporting connector is angled acutely relative to the shelves at the first angle and interlocks with the first slot of the fourth rung of the first side piece, and the second angled slot of the third shelf-supporting connector is angled acutely relative to the shelves at the second angle and interlocks with the first slot of the fourth rung of the second side piece;

wherein the third shelf is positioned atop the third shelf-supporting connector.

5. The shelf unit of claim 1, wherein each of the first and second side pieces includes a bottom rung, and wherein the bottom rungs support the shelf unit on a floor.

6. The shelf unit of claim 1, wherein at least one of the first or second shelves includes at least one recess for receiving a portion of at least one of the first or second side pieces.

7. The shelf unit of claim 1, wherein the first and second angles are each between 45 degrees and 80 degrees.

8. The shelf unit of claim 1, wherein the first and second angles are equal to each other.

9. The shelf unit of claim 1, wherein the first and second side pieces are angled relative each other at a third angle, and wherein the sum of the first, second, and third angles is 180 degrees.

10. The shelf unit of claim 1, wherein a length of the first shelf is greater than a length of the first shelf-supporting connector, and a length of the second shelf is greater than a length of the second shelf-supporting connector.

11. A shelf unit comprising:

first and second shelves, each oriented horizontally;

first and second side pieces, each including a top and a bottom, the first and second side pieces each including first and second rails and first, second, and third rungs extending between the first and second rails, the third rungs being adjacent the tops, and the first, second, and third rungs each including a first slot, wherein the first side piece is angled acutely relative to the shelves at a first angle and the second side piece is angled acutely relative to the shelves and toward the first side piece at a second angle such that the tops of the first and second side pieces are adjacent to each other, wherein the first and second angles are each between 45 degrees and 80 degrees and are equal to each other;

first and second shelf-supporting connectors, the first shelf-supporting connector attaching with the first rungs of the first and second side pieces and the second shelf-supporting connector attaching with the second rungs of the first and second side pieces, the first and second shelf-supporting connectors each including first and second angled slots, wherein the first angled slots are each angled acutely relative to the shelves at the first angle and the second angled slots are each angled acutely relative to the shelves at the second angle, wherein the first angled slot of the first shelf-supporting connector interlocks with the first slot of the first rung of the first side piece and the second angled slot of the first shelf-supporting connector interlocks with the first slot of the first rung of the second side piece, and wherein the first angled slot of the second shelf-supporting connector interlocks with the first slot of the second rung of the first side piece and the second angled slot of the second shelf-supporting connector interlocks with the first slot of the second rung of the second side piece; and a first top connector attaching with the third rungs of the first and second side pieces, the first top connector including first and second angled slots, wherein the first angled slot of the first top connector is angled acutely relative to the shelves at the first angle and interlocks with the first slot of the third rung of the first side piece, and the second angled slot of the first top connector is angled acutely relative to the shelves at the second angle and interlocks with the first slot of the third rung of the second side piece;

wherein the first shelf is positioned atop the first shelf-supporting connector and the second shelf is positioned atop the second shelf-supporting connector.

12. A shelf unit comprising:

first and second shelves, each oriented horizontally;

first and second side pieces, each including a top and a bottom, the first and second side pieces each including first and second rails and first, second, and third rungs extending between the first and second rails, the third rungs being adjacent the tops, and the first, second, and third rungs each including a first slot, wherein the first side piece is angled acutely relative to the shelves at a first angle and the second side piece is angled acutely relative to the shelves and toward the first side piece at a second angle such that the tops of the first and second side pieces are adjacent to each other, wherein the first and second angles are each between 45 degrees and 80 degrees;

first and second shelf-supporting connectors, the first shelf-supporting connector attaching with the first rungs of the first and second side pieces and the second shelf-supporting connector attaching with the second rungs of the first and second side pieces, the first and second shelf-supporting connectors each including first and second angled slots, wherein the first angled slots are each angled acutely relative to the shelves at the first angle and the second angled slots are each angled acutely relative to the shelves at the second angle, wherein the first angled slot of the first shelf-supporting connector interlocks with the first slot of the first rung of the first side piece and the second angled slot of the first shelf-supporting connector interlocks with the first slot of the first rung of the second side piece, and wherein the first angled slot of the second shelf-supporting connector interlocks with the first slot of the second rung of the first side piece and the second angled slot of the second shelf-supporting connector interlocks with the first slot of the second rung of the second side piece; and a first top connector attaching with the third rungs of the first and second side pieces, the first top connector including first and second angled slots, wherein the first angled slot of the first top connector is angled acutely relative to the shelves at the first angle and interlocks with the first slot of the third rung of the first side piece, and the second angled slot of the first top connector is angled acutely relative to the shelves at the second angle and interlocks with the first slot of the third rung of the second side piece;

wherein the first shelf is positioned atop the first shelf-supporting connector and the second shelf is positioned atop the second shelf-supporting connector, wherein a length of the first shelf is greater than a length of the first shelf-supporting connector, and a length of the second shelf is greater than a length of the second shelf-supporting connector.

* * * * *